US006672587B1

(12) United States Patent
Möhringer et al.

(10) Patent No.: US 6,672,587 B1
(45) Date of Patent: Jan. 6, 2004

(54) MULTIPLE-SHEET MONITORING DEVICE

(75) Inventors: Markus Möhringer, Mannheim; Jochen Renner, Edingen, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/578,769

(22) Filed: May 25, 2000

(30) Foreign Application Priority Data

May 28, 1999 (DE) ..... 199 24 692

(51) Int. Cl.[7] ..... B65H 7/02

(52) U.S. Cl. ..... 271/259; 271/261; 271/263; 271/265.02; 271/265.03; 271/265.04

(58) Field of Search ..... 271/259, 261, 271/262, 263, 265.02, 265.03, 265.04

(56) References Cited

U.S. PATENT DOCUMENTS 2,637,552 A 5/1953 Watson
4,021,030 A * 5/1977 Fichte et al.
4,132,402 A * 1/1979 Morrison et al. ..... 271/263
4,378,109 A 3/1983 Takahashi et al.
5,174,562 A * 12/1992 Mizunaga et al. ..... 271/263 X

FOREIGN PATENT DOCUMENTS

| | | | | |
|---|---|---|---|---|
| CA | 1100538 | * | 5/1981 | ..... 271/265.04 |
| DE | 953 172 | | 5/1956 | |
| DE | 3823201 | * | 12/1988 | ..... 271/263 |
| DE | 38 23 201 C2 | | 10/1992 | |
| GB | 630336 | | 10/1949 | |

* cited by examiner

*Primary Examiner*—David H. Bollinger
(74) *Attorney, Agent, or Firm*—Laurence A. Greenberg; Werner H. Stemer; Ralph E. Locher

(57) ABSTRACT

In a multiple-sheet monitoring device for sheet-processing machines, provision is made to arrange a number of sensing elements spaced apart from one another over the format width of the sheets to be conveyed or the sheet stream to be conveyed, and in this case all the sensing elements interact with the same switching element in order to stop the sheet-processing machine.

18 Claims, 3 Drawing Sheets

MULTIPLE-SHEET MONITORING DEVICE

BACKGROUND OF THE INVENTION

Field of the Invention

The invention relates to a multiple-sheet monitoring device and, more particularly, to such a device for sheet-processing machines, having a rotatable roller disposed underneath a sheet to be conveyed, a sensing element pivotally disposed at a spaced distance above the roller, and a switching element fixed in position, the switching element being actable upon in accordance with the pivoting position of the sensing element.

A multiple-sheet monitoring device of this general type has become known heretofore from the published German Patent Document DE 38 23 202 C2.

The lever for operating the switch and for supporting or holding the sensing element is disposed on a cyclically operated shaft in the aforementioned German Patent Document DE 38 23 202 C2. A continual reciprocating movement of the lever produces oscillations of the entire device and therefore leads to inaccurate measurement results.

SUMMARY OF THE INVENTION

It is accordingly an object of the invention to provide a multiple-sheet monitoring device which operates with greater precision than the heretofore known device of this general type.

With the foregoing and other objects in view, there is provided, in accordance with one aspect of the invention, a multiple-sheet monitoring device for a sheet-processing machine, having a plurality of sensing elements pivotally disposed above a sheet and an overlapping sheet stream, respectively, at a spaced distance therefrom, and a switching element disposed in a fixed position and being actable upon in accordance with the pivoting position of the sensing elements, the sensing elements being arranged over the format width of the sheets and the overlapping sheet stream, respectively, to be conveyed, comprising an adjustment device for adjusting all of the sensing elements in common to the thickness of a sheet to be processed.

In accordance with another aspect of the invention, there is provided a multiple-sheet monitoring device for sheet-processing machines, having a rotatable roller disposed underneath a sheet to be conveyed, a sensing element pivotally disposed at a spaced distance above the roller, and a switching element fixed in position, the switching element being actable upon in accordance with the pivoting position of the sensing element, comprising a pivotable cross member, and an actuating element for the switching element mounted on the cross member so as to be fixed against rotation relative thereto.

In accordance with another feature of the invention, the multiple-sheet monitoring device includes at least one additional sensing element, and all of the sensing elements cooperate with only one switching element.

In accordance with a further aspect of the invention, there is provided an assembly including the multiple-sheet monitoring device, wherein the multiple-sheet monitoring device is disposed in vicinity of the beginning of a feed table.

In accordance with an added feature of the invention, the sensing element is a roller.

In accordance with an additional feature of the invention, the multiple-sheet monitoring device includes a counter-roller spaced from the sensing roller, and an adjusting screw for indirectly adjusting the spaced distance between the sensing roller and the counter-roller via a pivotable support.

In accordance with yet another feature of the invention, the switching element is mounted on a holder and is adjustable in common therewith by the adjusting screw.

In accordance with yet a further feature of the invention, the spaced distance between the sensing roller and the counter-roller is slightly greater than the thickness of the sheet and an overlapping sheet stream, respectively, to be monitored.

In accordance with yet an added feature of the invention, a rotatable roller is mounted underneath the sheet and an overlapping sheet stream, respectively, to be conveyed.

In accordance with yet an additional feature of the invention, the roller is disposed opposite to the sensing element.

In accordance with still another feature of the invention, all of the sensing elements cooperate with only one switch element.

In accordance with still a further feature of the invention, the sensing elements are rollers.

In accordance with still an added feature of the invention, the multiple-sheet monitoring device includes a respective counter-roller spaced from each of the sensing rollers, and an adjusting screw for indirectly adjusting the spaced distance between the respective sensing rollers and counter-rollers via a pivotable support.

In accordance with still an additional feature of the invention, the spaced distance between the respective sensing rollers and counter-rollers is slightly greater than the thickness of the sheet and an overlapping sheet stream, respectively, to be monitored.

In accordance with another feature of the invention, a plurality of rotatable rollers are mounted underneath the sheet and the overlapping sheet stream, respectively, to be conveyed.

In accordance with a concomitant aspect of the invention, there is provided an assembly including the multiple-sheet monitoring device, wherein the rotatable rollers, respectively, are disposed opposite the plurality of sensing elements, respectively.

Thus, a significant advantage of the invention lies in the arrangement of a number of sensing elements, at least two thereof, side-by-side on the cross member. Due to this feature, the sheet and the overlapping sheet stream, respectively, can be monitored simultaneously at a number of locations. In particular, in an edge region of the sheet and the overlapping sheet stream, respectively, dog-eared corners are reliably detectable.

A further advantage of the invention is the arrangement of an actuating element for a switching element that is provided, so that it is fixed against rotation relative to the pivotable cross member of the sensing elements.

It is therefore necessary for only one switch to be provided, because each sensing element is arranged so that it is fixed against rotation relative to the pivotable cross member, and each deflection of a sensing element results in the actuation of the switch.

The multiple-sheet monitoring device is preferably installed at the beginning of the conveyor table. Due to this feature, a large time window is afforded for stopping the sheet-processing machine, in particular a printing machine, even at high processing speeds.

The sheet and overlapping sheet stream, respectively, are advantageously monitored without contact with the sensing roller, because only when multiple sheets or faulty sheets are present is the sensing roller contacted and a pivoting movement initiated, which causes a stoppage of the sheet conveying system.

Other features which are considered as characteristic for the invention are set forth in the appended claims.

Although the invention is illustrated and described herein as embodied in a multiple-sheet monitoring device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
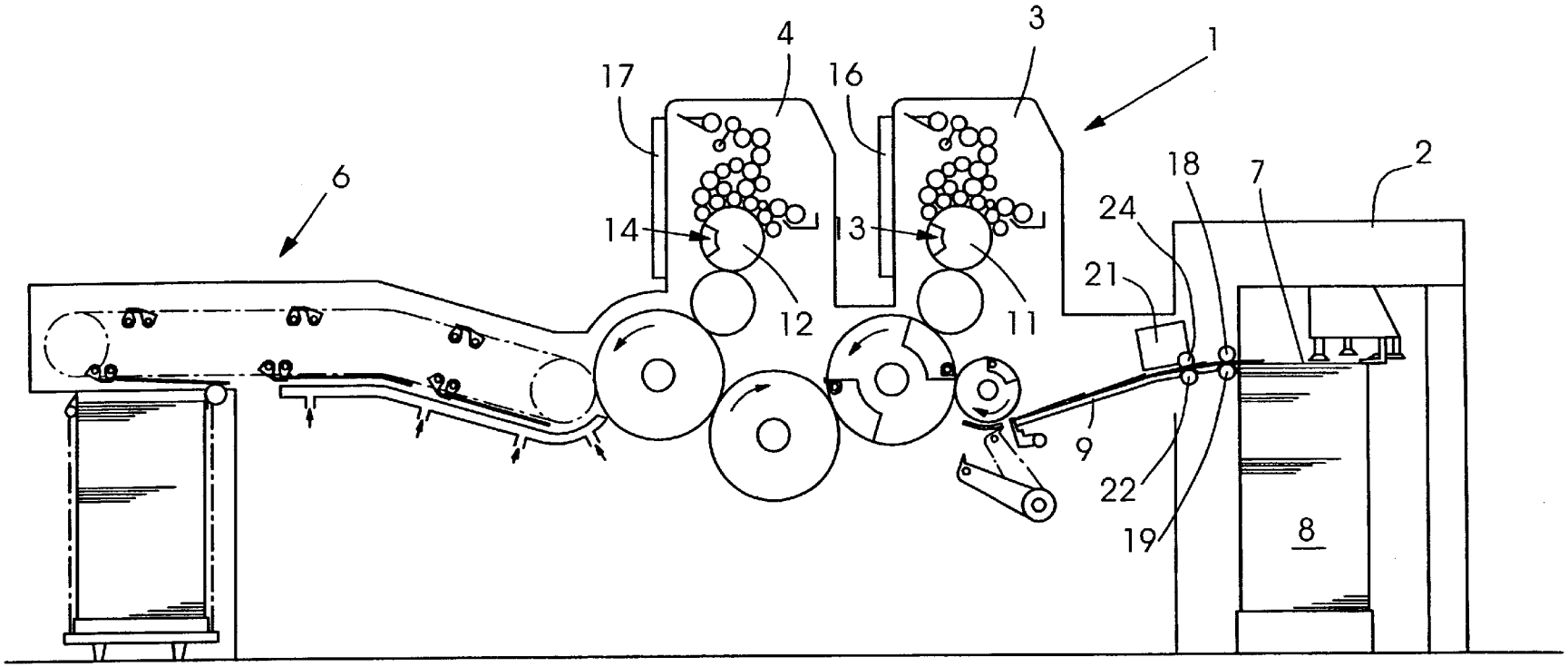
FIG. 1 is a diagrammatic side elevational view of a sheet-fed rotary printing machine incorporating the multiple-sheet monitoring device according to the invention.

Referring now to the drawings and, first, particularly to FIG. 1 thereof, there is shown therein a rotary printing machine, for example a printing machine 1 for processing sheets 7, having a feeder 2, at least one printing unit 3, 4 and a delivery 6. The sheets 7 are taken off a sheet pile 8 and fed separately or in overlapping or imbricated form over a feed table 9 to the printing units 3 and 4. Each of the printing units 3 and 4 includes, in a conventional manner, a respective plate cylinder 11, 12. Each of the plate cylinders 11 and 12, respectively, has a device 13, 14 for fastening flexible printing plates thereon. In addition, a respective device 16, 17 for semiautomatic or fully automatic printing-plate changing is assigned to each plate cylinder 11, 12.

Disposed first of all between a feeder 2 and a feed table 9, as viewed in the sheet conveying direction, is a cyclically operated roller pair 18, 19. The cyclically operated roller 18 is freely rotatably mounted and reciprocatingly movable, due to which a spaced distance between the cyclically operated roller 18 and the driven counter-roller 19 is reduced and increased at the cycle rate of the sheet-processing machine. Disposed downline from the cyclically operated roller pair 18, 19 in the sheet-conveying direction is a multiple-sheet monitoring device 21 according to the invention, which is located at the beginning of the feed table 9. The multiple-sheet monitoring device 21 includes for the most part a freely rotatably mounted counter-roller 22 which, as shown in FIG. 2, is disposed in a recess 23 formed in the feed table 21, and a sensing element 24 located above the feed table 21, opposite the counter-roller 22.

The sensing element 24 is preferably constructed as a rotatably mounted roller. other forms, such as a sliding shoe, a stirrup, a sensing pin or the like, are conceivable.

Figure 2:
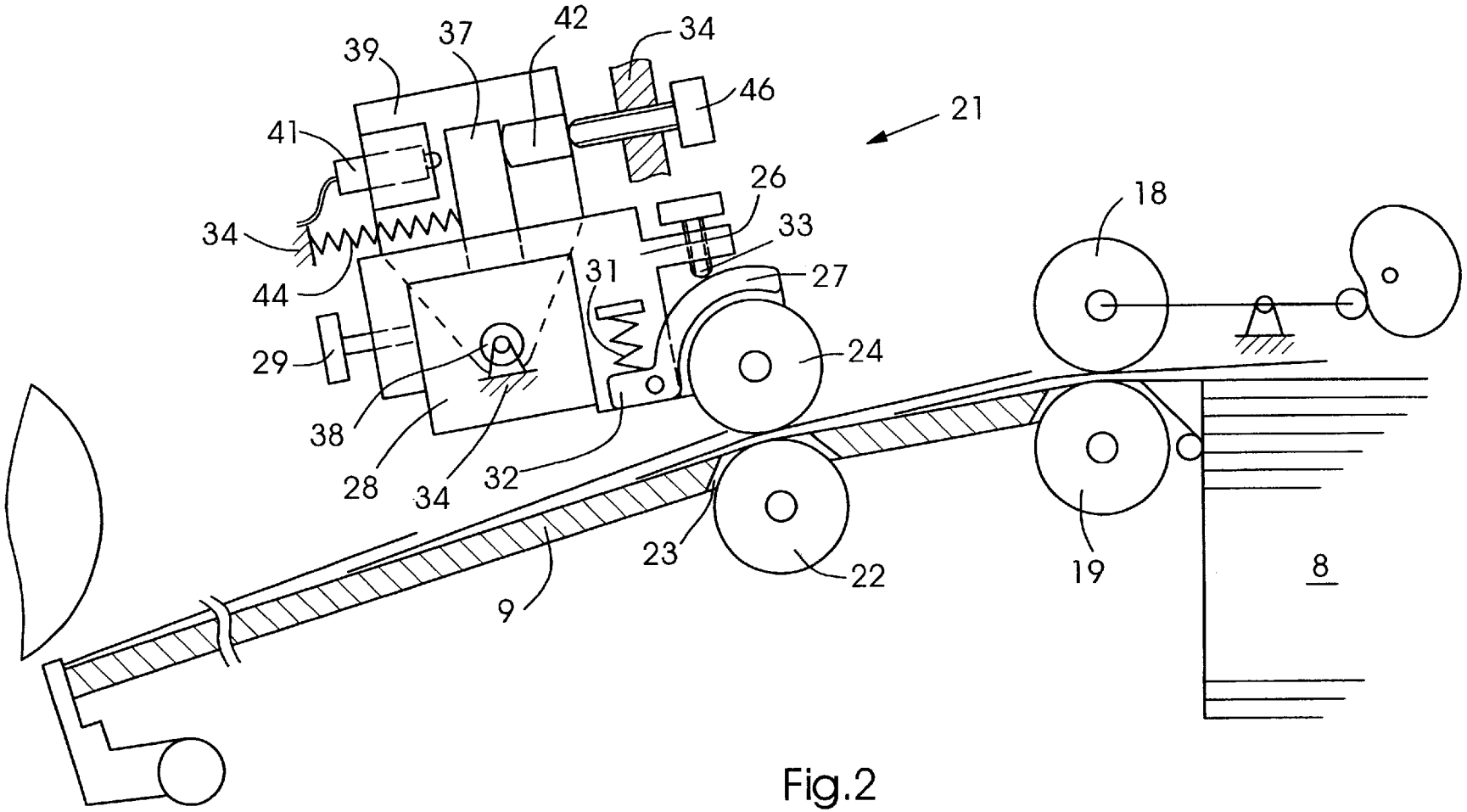
FIG. 2 is a much-enlarged fragmentary view of FIG. 1 showing the multiple-sheet monitoring device in greater detail.

As further seen in FIG. 2, the rotatably mounted roller 24 is seated on a lever 27 pivotally mounted on a support or holder 26 that is axially displaceable on a cross member 28. A locking screw 29 serves to secure the support or holder 26 in a desired position. Supported on the support or holder 26 is a compression spring 31, which acts at one end thereof on an arm 32 of the lever 27, so that the latter is pressed against an adjustable stop 33.

Figure 3:
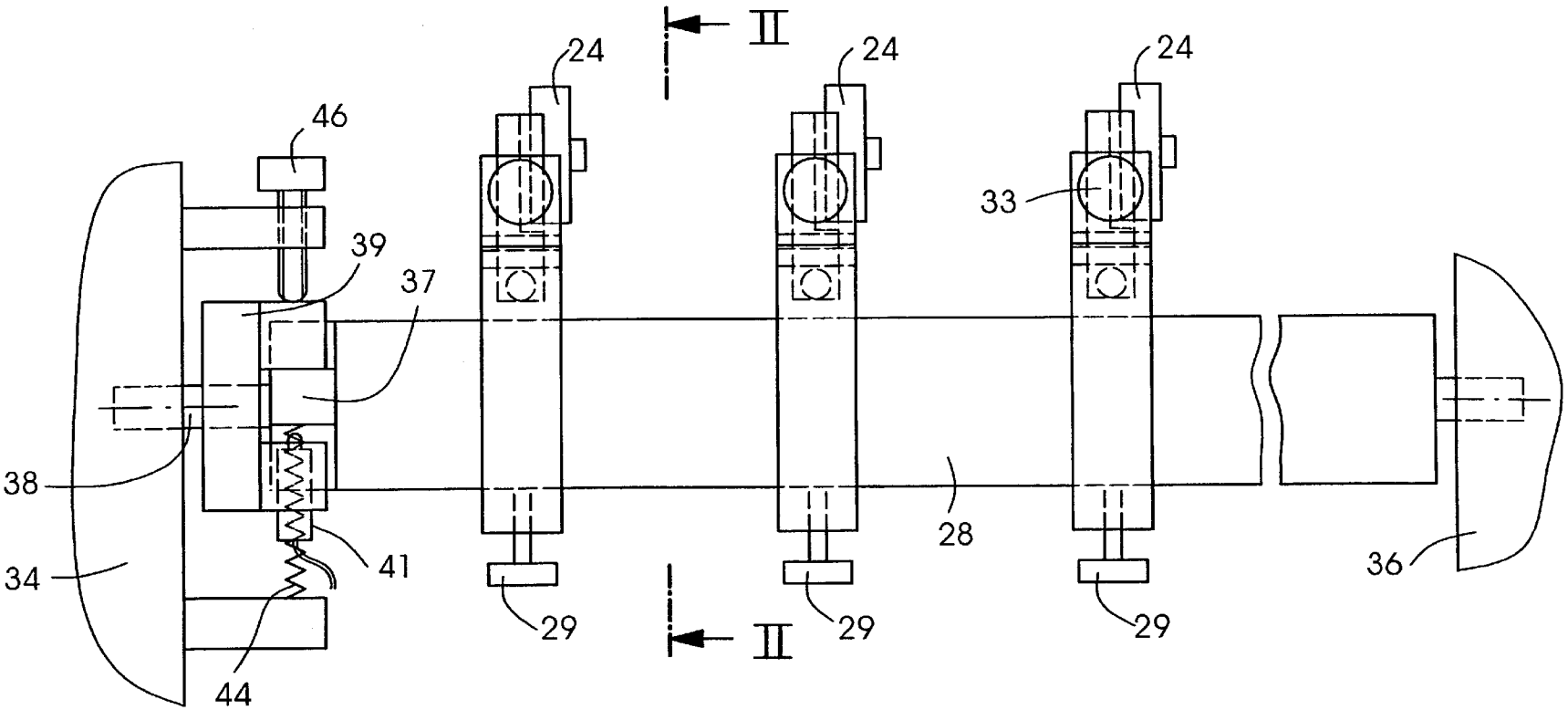
FIG. 3 is a slightly enlarged plan view, rotated approximately 45° counterclockwise, of the multiple-sheet monitoring device shown in FIG. 2.

The cross member 28 is pivotally mounted in side frames 34 and 36, as shown in FIG. 3. In the vicinity of the side frame 34, as shown in FIG. 3, the cross member 28 is formed with a lever 37.

A holder 39 for a switch 41 for stopping the sheet-conveying system is pivotally seated on a bearing journal 38 of the cross member 28.

In addition, the holder 39 carries a stop 42 that engages with the lever 37. A compression spring 44 supported on the side frame 34 presses the lever 37 against the stop 42. An adjusting screw 46 cooperates with the holder 39 and pivots the latter about the bearing journal 38 counter to the force of the compression spring 44. Due to this measure, the distance between the roller 24 and the counter-roller 22 is adjusted when the thickness of the printing material is changed.

In order to detect small pieces or scraps of sheets, a relatively large number of supports or holders 26, respectively, having an assigned sensing roller 24 are arranged on the cross member 28. In order to adjust in common all of the sensing rollers 24 arranged on the cross member 28 to the thickness of the sheets to be processed, for example, the thickness of the printing material in the case of printing machines, the common adjusting screw 46 is used.

For the purpose of mutually aligning the sensing rollers 24 vertically, the adjustable stop 33 is provided, for example, in the course of the basic adjustment made during assembly.

The result of any deflection of a single sensing roller 24 is that the cross member 28 is pivoted counter to the force of the compression spring 44 which engages the lever 37. Upon the occurrence of a pivoting movement, the lever 37 comes into contact with the switch 41, which then stops the sheet-conveying system.

We claim:

1. A multiple-sheet monitoring device for a sheet-processing machine, comprising:

a cross-member;

a plurality of sensing elements disposed jointly on the cross-member and pivotally above and over a format width of a sheet and an overlapping sheet stream, respectively, at a spaced distance from the sheet and the overlapping sheet stream;

a switching element disposed in a fixed position and being actable upon in accordance with a pivoting position of the sensing elements; and an adjustment device for adjusting all of the sensing elements in common to a thickness of the sheet and the overlapping sheet stream, respectively.

2. The multiple-sheet monitoring device according to claim 1, including an actuating element for the switching element mounted on the cross member so as to be fixed against rotation relative thereto and wherein all of the sensing elements cooperate with only one switch element through the actuating element.

3. An assembly including the multiple-sheet monitoring device according to claim 2, wherein the multiple-sheet monitoring device is disposed in vicinity of the beginning of a feed table.

4. The multiple-sheet monitoring device according to claim 1, wherein the sensing elements are rollers.

5. The multiple-sheet monitoring device according to claim 1, including a respective counter-roller spaced from each of said sensing rollers, and an adjusting screw for indirectly adjusting the spaced distance between the respective sensing rollers and counter-rollers via a pivotable support.

6. The multiple-sheet monitoring device according to claim 5, wherein the switching element is mounted on a holder and is adjustable in common therewith by said adjusting screw.

7. The multiple-sheet monitoring device according to claim 6, wherein the spaced distance between the respective sensing rollers and counter-rollers is slightly greater than the thickness of the sheet and an overlapping sheet stream, respectively, to be monitored.

8. The multiple-sheet monitoring device according to claim 1, wherein a plurality of rotatable rollers are mounted underneath the sheet and the overlapping sheet stream, respectively, to be conveyed.

9. An assembly including the multiple-sheet monitoring device according to claim 8, wherein said rotatable rollers, respectively, are disposed opposite the plurality of sensing elements, respectively.

10. A multiple-sheet monitoring device for sheet-processing machines, comprising:

a rotatable roller disposed underneath a sheet to be conveyed;

a sensing element pivotally disposed at a spaced distance above the roller;

a pivotable cross member;

a switching element fixed in position, the switching element being actable upon in accordance with a pivoting position of the sensing element; and an actuating element for the switching element mounted on the cross member so as to be fixed against rotation relative thereto.

11. The multiple-sheet monitoring device according to claim 10, including at least one additional sensing element, and wherein all of the sensing elements cooperate with only one switching element through the actuating element.

12. An assembly including the multiple-sheet monitoring device according to claim 10, wherein the multiple-sheet monitoring device is disposed in vicinity of the beginning of a feed table.

13. The multiple-sheet monitoring device according to claim 10, wherein the sensing element is a sensing roller.

14. The multiple-sheet monitoring device according to claim 13, including a counter-roller spaced from said sensing roller, and an adjusting screw for indirectly adjusting the spaced distance between said sensing roller and said counter-roller via a pivotable support.

15. The multiple-sheet monitoring device according to claim 14, wherein the switching element is mounted on a holder and is adjustable in common therewith by said adjusting screw.

16. The multiple-sheet monitoring device according to claim 14, wherein the spaced distance between the sensing roller and said counter-roller is slightly greater than the thickness of the sheet and an overlapping sheet stream, respectively, to be monitored.

17. The multiple-sheet monitoring device according to claim 10, wherein a rotatable roller is mounted underneath the sheet and an overlapping sheet stream, respectively, to be conveyed.

18. The multiple-sheet monitoring device according to claim 17, wherein said roller is disposed opposite to the sensing element.

* * * * *